US007073425B1

(12) United States Patent
Allen et al.

(10) Patent No.: US 7,073,425 B1
(45) Date of Patent: Jul. 11, 2006

(54) METHOD OF MAKING AN ENVIRONMENTALLY SAFE SUBSTITUTE FOR LEAD SHOT

(76) Inventors: James Robert Allen, 7450 Setter Dr., Anchorage, AK (US) 99502; Michael B Katz, 6 Kings Gate Rd., Suffern, NY (US) 10901

( * ) Notice: Subject to any disclaimer, the term of this patent is extended or adjusted under 35 U.S.C. 154(b) by 0 days.

(21) Appl. No.: 10/944,558

(22) Filed: Sep. 17, 2004

Related U.S. Application Data

(62) Division of application No. 10/629,153, filed on Jul. 29, 2003.

(51) Int. Cl.
*F42B 33/00* (2006.01)

(52) U.S. Cl. ..... 86/57; 86/55; 102/517; 102/448; 102/459; 29/899

(58) Field of Classification Search ..... 86/57, 86/54, 55; 102/517, 618, 448, 459; 29/899
See application file for complete search history.

(56) References Cited

U.S. PATENT DOCUMENTS

| | | | | | |
|---|---|---|---|---|---|
| 3,120,188 | A * | 2/1964 | Kreuzer | 102/514 |
| 3,125,794 | A * | 3/1964 | Reynolds | 29/899 |
| 4,881,465 | A * | 11/1989 | Hooper et al. | 102/501 |
| 5,189,252 | A * | 2/1993 | Huffman et al. | 102/459 |
| 5,279,787 | A * | 1/1994 | Oltrogge | 419/38 |
| 5,513,689 | A * | 5/1996 | Montgomery et al. | 164/113 |
| 5,597,975 | A * | 1/1997 | Satow | 102/514 |
| 5,760,331 | A * | 6/1998 | Lowden et al. | 102/506 |
| 6,209,180 | B1 * | 4/2001 | Amick | 88/57 |

* cited by examiner

*Primary Examiner*—M. Clement
(74) *Attorney, Agent, or Firm*—Michael J. Tavella

(57) ABSTRACT

A shot pellet that, has an inner core of a material such tungsten carbide, that is coated with a layer of bismuth. This coating is molecularly bonded to the tungsten carbide and is not an alloy. The unique properties of the shot pellet allow its density to be tailored. Under this process, the effective density of the pellet can be made to be identical to lead for direct replacement in current lead loading formulations. Additionally, the density can be made to be lower than lead for shotguns requiring low barrel pressures, or higher than lead for enhanced energy transfer while maintaining the other advantages of the instant invention.

4 Claims, 2 Drawing Sheets

| Various Shot Baseline data | | | | | | | | | | Expected | Actual | Full Choke | Shot |
|---|---|---|---|---|---|---|---|---|---|---|---|---|---|
| Lead String# | Gauge | Hull | Primer | Powder | Breech LUP's | Quantity | Shot size | weight | Shot # | Velocity FPS | Velocity FPS | % 30" Circle 35 Yards | Count in circle |
| 25 total | 28 | WAA | W209 | HERCO | 8400 | 14.0 gr | 8 1/2 | .75 oz | 439 | 1200 | | | |
| 1 of 5 | 28 | WAA | W209 | HERCO | 8400 | 14.0 gr | 8 1/2 | .75 oz | 439 | 1200 | 1313 | 70.2% | 308 |
| 2 of 5 | 28 | WAA | W209 | HERCO | 8400 | 14.0 gr | 8 1/2 | .75 oz | 439 | 1200 | 1317 | 72.7% | 319 |
| 3 of 5 | 28 | WAA | W209 | HERCO | 8400 | 14.0 gr | 8 1/2 | .75 oz | 439 | 1200 | 1313 | 70.4% | 309 |
| 4 of 5 | 28 | WAA | W209 | HERCO | 8400 | 14.0 gr | 8 1/2 | .75 oz | 439 | 1200 | 1305 | 71.1% | 312 |
| 5 of 5 | 28 | WAA | W209 | HERCO | 8400 | 14.0 gr | 8 1/2 | .75 oz | 439 | 1200 | 1265 | 73.3% | 322 |
| Bismuth | | | | | | | | Average | | 1200 | 1302.6 | | 314 |
| 1 of 5 | 28 | WAA28 | W209 | HERCO | 8400 | 14.0 gr | 5 | .75 OZ | 128 | 1200 | 1293 | 71% | 91 |
| 2 of 5 | 28 | WAA28 | W209 | HERCO | 8400 | 14.0 gr | 5 | .75 OZ | 128 | 1200 | 1316 | 74% | 95 |
| 3 of 5 | 28 | WAA28 | W209 | HERCO | 8400 | 14.0 gr | 5 | .75 OZ | 128 | 1200 | 1442 | 70% | 89 |
| 4 of 5 | 28 | WAA28 | W209 | HERCO | 8400 | 14.0 gr | 5 | .75 OZ | 128 | 1200 | 1520 | 69% | 88 |
| 5 of 5 | 28 | WAA28 | W209 | HERCO | 8400 | 14.0 gr | 5 | .75 OZ | 128 | 1200 | 1442 | 70% | 90 |
| Hevi-Shot | | | | | | | | Average | | 1200 | 1402.6 | | 90.6 |
| 1 of 5 | 28 | WAA28 | W209 | HERCO | 8400 | 14.0 gr | 6 | .75 OZ | 169 | 1200 | 1287 | 70.4% | 119 |
| 2 of 5 | 28 | WAA28 | W209 | HERCO | 8400 | 14.0 gr | 6 | .75 OZ | 169 | 1200 | 1265 | 69.8% | 118 |
| 3 of 5 | 28 | WAA28 | W209 | HERCO | 8400 | 14.0 gr | 6 | .75 OZ | 169 | 1200 | 1289 | 71.6% | 121 |
| 4 of 5 | 28 | WAA28 | W209 | HERCO | 8400 | 14.0 gr | 6 | .75 OZ | 169 | 1200 | 1252 | 71.0% | 120 |
| 5 of 5 | 28 | WAA28 | W209 | HERCO | 8400 | 14.0 gr | 6 | .75 OZ | 169 | 1200 | 1263 | 72.2% | 122 |
| Lead #2 | | | | | | | | Average | | 1200 | 1271.2 | 71.0% | 120 |
| 1 of 5 | 28 | WAA28 | W209 | HERCO | 8400 | 14.0 gr | 6 | .75 OZ | 169 | 1200 | 1321 | 72% | 122 |
| 2 of 5 | 28 | WAA28 | W209 | HERCO | 8400 | 14.0 gr | 6 | .75 OZ | 169 | 1200 | 1326 | 70% | 118 |
| 3 of 5 | 28 | WAA28 | W209 | HERCO | 8400 | 14.0 gr | 6 | .75 OZ | 169 | 1200 | 1306 | 73% | 124 |
| 4 of 5 | 28 | WAA28 | W209 | HERCO | 8400 | 14.0 gr | 6 | .75 OZ | 169 | 1200 | 1310 | 70% | 119 |
| 5 of 5 | 28 | WAA28 | W209 | HERCO | 8400 | 14.0 gr | 6 | .75 OZ | 169 | 1200 | 1284 | 71% | 120 |
| Enviro-Shot | | | | | | | | Average | | 1200 | 1309.4 | | 120.6 |
| 1 of 5 | 28 | WAA28 | W209 | HERCO | 8400 | 14.0 gr | 6 | .75 OZ | 169 | 1200 | 1299 | 73.0% | 124 |
| 2 of 5 | 28 | WAA28 | W209 | HERCO | 8400 | 14.0 gr | 6 | .75 OZ | 169 | 1200 | 1311 | 75.0% | 127 |
| 3 of 5 | 28 | WAA28 | W209 | HERCO | 8400 | 14.0 gr | 6 | .75 OZ | 169 | 1200 | 1306 | 72.0% | 122 |
| 4 of 5 | 28 | WAA28 | W209 | HERCO | 8400 | 14.0 gr | 6 | .75 OZ | 169 | 1200 | 1324 | 72.0% | 121 |
| 5 of 5 | 28 | WAA28 | W209 | HERCO | 8400 | 14.0 gr | 6 | .75 OZ | 169 | 1200 | 1318 | 74.0% | 125 |
| | | | | | | | | Average | | 1200 | 1311.6 | 73.2% | 123.8 |

Various Shot Baseline data

| Lead String# | Gauge | Hull | Primer | Powder | Breech LUP's | Quantity | Shot size | weight | Shot # | Expected Velocity FPS | Actual Velocity FPS | Full Choke % 30" Circle 35 Yards | Shot Count in circle |
|---|---|---|---|---|---|---|---|---|---|---|---|---|---|
| 25 total | 28 | WAA | W209 | HERCO | 8400 | 14.0 gr | 8 1/2 | .75 oz | 439 | 1200 | | | |
| 1 of 5 | 28 | WAA | W209 | HERCO | 8400 | 14.0 gr | 8 1/2 | .75 oz | 439 | 1200 | 1313 | 70.2% | 308 |
| 2 of 5 | 28 | WAA | W209 | HERCO | 8400 | 14.0 gr | 8 1/2 | .75 oz | 439 | 1200 | 1317 | 72.7% | 319 |
| 3 of 5 | 28 | WAA | W209 | HERCO | 8400 | 14.0 gr | 8 1/2 | .75 oz | 439 | 1200 | 1313 | 70.4% | 309 |
| 4 of 5 | 28 | WAA | W209 | HERCO | 8400 | 14.0 gr | 8 1/2 | .75 oz | 439 | 1200 | 1305 | 71.1% | 312 |
| 5 of 5 | 28 | WAA | W209 | HERCO | 8400 | 14.0 gr | 8 1/2 | .75 oz | 439 | 1200 | 1265 | 73.3% | 322 |
| Bismuth | | | | | | | | Average | | 1200 | 1302.6 | | 314 |
| 1 of 5 | 28 | WAA28 | W209 | HERCO | 8400 | 14.0 gr | 5 | .75 OZ | 128 | 1200 | 1293 | 71% | 91 |
| 2 of 5 | 28 | WAA28 | W209 | HERCO | 8400 | 14.0 gr | 5 | .75 OZ | 128 | 1200 | 1316 | 74% | 95 |
| 3 of 5 | 28 | WAA28 | W209 | HERCO | 8400 | 14.0 gr | 5 | .75 OZ | 128 | 1200 | 1442 | 70% | 89 |
| 4 of 5 | 28 | WAA28 | W209 | HERCO | 8400 | 14.0 gr | 5 | .75 OZ | 128 | 1200 | 1520 | 69% | 88 |
| 5 of 5 | 28 | WAA28 | W209 | HERCO | 8400 | 14.0 gr | 5 | .75 OZ | 128 | 1200 | 1442 | 70% | 90 |
| Hevi-Shot | | | | | | | | Average | | 1200 | 1402.6 | | 90.6 |
| 1 of 5 | 28 | WAA28 | W209 | HERCO | 8400 | 14.0 gr | 6 | .75 OZ | 169 | 1200 | 1287 | 70.4% | 119 |
| 2 of 5 | 28 | WAA28 | W209 | HERCO | 8400 | 14.0 gr | 6 | .75 OZ | 169 | 1200 | 1265 | 69.8% | 118 |
| 3 of 5 | 28 | WAA28 | W209 | HERCO | 8400 | 14.0 gr | 6 | .75 OZ | 169 | 1200 | 1289 | 71.6% | 121 |
| 4 of 5 | 28 | WAA28 | W209 | HERCO | 8400 | 14.0 gr | 6 | .75 OZ | 169 | 1200 | 1252 | 71.0% | 120 |
| 5 of 5 | 28 | WAA28 | W209 | HERCO | 8400 | 14.0 gr | 6 | .75 OZ | 169 | 1200 | 1263 | 72.2% | 122 |
| Lead #2 | | | | | | | | Average | | 1200 | 1271.2 | 71.0% | 120 |
| 1 of 5 | 28 | WAA28 | W209 | HERCO | 8400 | 14.0 gr | 6 | .75 OZ | 169 | 1200 | 1321 | 72% | 122 |
| 2 of 5 | 28 | WAA28 | W209 | HERCO | 8400 | 14.0 gr | 6 | .75 OZ | 169 | 1200 | 1326 | 70% | 118 |
| 3 of 5 | 28 | WAA28 | W209 | HERCO | 8400 | 14.0 gr | 6 | .75 OZ | 169 | 1200 | 1306 | 73% | 124 |
| 4 of 5 | 28 | WAA28 | W209 | HERCO | 8400 | 14.0 gr | 6 | .75 OZ | 169 | 1200 | 1310 | 70% | 119 |
| 5 of 5 | 28 | WAA28 | W209 | HERCO | 8400 | 14.0 gr | 6 | .75 OZ | 169 | 1200 | 1284 | 71% | 120 |
| Enviro-Shot | | | | | | | | Average | | 1200 | 1309.4 | | 120.6 |
| 1 of 5 | 28 | WAA28 | W209 | HERCO | 8400 | 14.0 gr | 6 | .75 OZ | 169 | 1200 | 1299 | 73.0% | 124 |
| 2 of 5 | 28 | WAA28 | W209 | HERCO | 8400 | 14.0 gr | 6 | .75 OZ | 169 | 1200 | 1311 | 75.0% | 127 |
| 3 of 5 | 28 | WAA28 | W209 | HERCO | 8400 | 14.0 gr | 6 | .75 OZ | 169 | 1200 | 1306 | 72.0% | 122 |
| 4 of 5 | 28 | WAA28 | W209 | HERCO | 8400 | 14.0 gr | 6 | .75 OZ | 169 | 1200 | 1324 | 72.0% | 121 |
| 5 of 5 | 28 | WAA28 | W209 | HERCO | 8400 | 14.0 gr | 6 | .75 OZ | 169 | 1200 | 1318 | 74.0% | 125 |
| | | | | | | | | Average | | 1200 | 1311.6 | 73.2% | 123.8 |

Figure 1

METHOD OF MAKING AN ENVIRONMENTALLY SAFE SUBSTITUTE FOR LEAD SHOT

CROSS REFERENCE TO RELATED APPLICATIONS

This application is a division of application Ser. No. 10/629,153, filed Jul. 29, 2003.

STATEMENT REGARDING FEDERALLY SPONSORED RESEARCH AND DEVELOPMENT

Not Applicable

BACKGROUND OF THE INVENTION

1. Field of the Invention

This invention relates to substitutes for lead shot tools and particularly to environmentally safe substitutes for lead shot.

2. Description of the Prior Art

Because the use of traditional lead (Pb) shot has been outlawed for waterfowl hunting in the U.S., Canada, UK and other countries, much effort has been devoted to identifying a suitable substitute. To be fully satisfactory, alternative shot must possess the following attributes:

a) The material should have density similar to that of lead (Pb) shot, typically 11.0 g/cm$^3$.

b) The material must not cause physiological problems in wildlife that may ingest spent shot from the ground or water.

c) The material must not cause significant damage to shotgun barrels.

d) The shot must possess sufficient strength, rigidity and toughness to adequately withstand "set-back" forces associated with firing and to penetrate the target effectively without shattering or excessively deforming.

e) For purposes of game law enforcement, shot material should preferably be magnetic to easily differentiate it from illegal lead shot.

f) Material used for shot must be economical to obtain and fabricate into spherical product.

None of the alternative shot types currently available conforms to all of the above criteria. Current products in the USA include shot made of steel, bismuth alloy, iron-tungsten alloy and tungsten-polymer composite. Each of these will be reviewed and critiqued in the following discussion, followed by a review of other prior art, which has not yet become commercialized.

Steel Shot

The most widely used alternative shot is carbon steel, in spite of the fact that its density is quite low (about 7.9 g/cm.$^3$) in comparison with that of lead shot (about 11.0 g/cm$^3$). Inarguable principles of physics and engineering establish that an object of lower density, when moving through a fluid (such as air), will carry less energy at any given velocity, and experience more rapid loss of velocity (due to drag forces) than an object of higher density of the same size and shape. Shot shell manufacturers have employed special powders to increase steel shot velocity, in an attempt to ameliorate its inferior ballistic properties. The "hotter" powders unfortunately create higher pressures within the gun barrel. Safety considerations have therefore prompted shot shell manufacturers to recommend that steel shells only be fired in certain types of modern, high-strength shotguns.

There is also a significant negative impact of steel shot on the very same wildlife, which the outlawing of lead is intended to preserve. The inferior ballistics of steel shot, in the hands of the public, has resulted in higher rates of "crippling" shots. This is because generations of hunters accustomed to shooting traditional lead shot tend to attempt to shoot waterfowl at the same distances that they have always considered to be "in range."

Another approach taken by steel shot shell manufacturers has been to simply substitute larger steel shot for traditional lead shot sizes, in order to provide equivalent mass. This practice has the obvious disadvantage that there are fewer shot in any given shell. The "pattern density" of the cloud of shot is lower at any given distance from the point of firing. This sparse pattern again increases the probability that birds will be crippled, rather than harvested for consumption.

Bismuth alloy shot shells (see e.g., U.S. Pat. No. 4,949,644 to Brown) are currently marketed in the USA at approximately three times the cost of steel shells. Unfortunately, bismuth alloys are not equivalent to lead in density (about 9.4 g/cm.$^3$ vs. 11.0 g/cm.$^3$), although somewhat more dense than steel (7.9 g/cm.$^3$). In addition to this shortcoming, bismuth alloys are inherently brittle and therefore tend to fracture and disintegrate upon impact. As fracture surfaces form in the shot, energy is lost, which would otherwise be available to enhance penetration of the target. In this instance, it is even likely that all the increased energy gained by having higher density pellets than steel is lost as fracture occurs. Finally, it should be noted that bismuth is non-magnetic and cannot be readily distinguished from illegal lead shot by game officers in the field.

U.S. Pat. Nos. 5,264,022, 5,527,376, and 5,713,981 disclose a more recent product, which began to be marketed in the USA in 1997. It is a shot shell containing binary iron-tungsten alloy shot (60% Fe-40% W, by weight). Because the Fe—W is very hard (about Rockwell C50), it must be ground with ceramic abrasives (alumina, silicon-carbide, diamond, etc.), particles of which become imbedded in the shot surface. As a result, this type of shot produces severe damage in all gun barrels unless the shot is encapsulated in a special "overlapping double-wall" plastic shot-cup of heavy construction. Even with this precautionary design, the manufacturer prints a clear message on each box of product disclaiming any responsibility for gun barrel damage or personal injury. The consequences of forming longitudinal scratches in the barrel caused by this shot are that stresses produced by the expanding explosive gases will be concentrated in the regions around the scratches. A primary concern is that these stresses may be sufficiently high to cause catastrophic bursting of the barrel.

Whether adequately protective or not, the special plastic shot-cup (or "wad") creates another significant problem. The wad must be made of plastic tubing so thick as to make it impossible to load quantities of shot equivalent to those of traditional lead shells. For example, Fe—W shells of 2¾-inch length for 12-gauge guns contain only 1.0 ounce of shot versus 1⅛to 1¼ounces in corresponding lead or steel shells. The deficient pellet numbers result in correspondingly sparse pattern densities, the same problem encountered in substituting larger steel shot for traditional lead sizes, as mentioned previously.

Although denser than bismuth shot, Fe—W shot currently marketed is still considerably less dense than lead shot (about 10.2–10.5 g/cm.$^3$ vs. 11.0 g/cm.$^3$). When this fact is combined with the lower pattern densities, the purported advantages of Fe—W shot over steel shot become questionable.

Finally, problems associated with manufacturability, and their adverse effects on product cost, are relatively severe. The constituent phases in Fe—W alloys cause the shot to be so hard and brittle as to be impossible to forge or swage these alloys into rods, or even to shape them compressively into spheres. Although the referenced patents claim Fe—W shot can be made by casting, the inherent brittleness and high melting temperatures of these alloys caused cracking to occur during rapid cooling. Cracking also plagued the process of compressive grinding, which was tried as a means of rounding the generally asymmetrical shot. Consequently, the shot actually being produced and marketed must be made by an expensive powder metallurgical method. Even with this approach, only larger shot sizes ("BB" 0.180-inch-diameter, and "#2" 0.150-inch-diameter) are being produced at present. This is because powder-processing costs increase exponentially as shot sizes decrease. Furthermore, the fragility of compaction tooling becomes a limiting factor as shot size decreases. Shot sizes #4 (0.130-inch), #5 (0.120-inch), #6 (0.110-inch) and #71/2 (0.095-inch), traditionally preferred for hunting all but the very largest game birds (such as geese), are unavailable for these reasons.

Attempts to increase Fe—W shot densities to be equivalent to lead shot are frustrated by the fact that elevating tungsten content not only raises material costs but further exacerbates manufacturing problems. As in the case of bismuth shot, Fe—W shells are about three times as expensive as steel shells, thereby rendering them unaffordable by the average sportsman. Unlike steel shot, which can be obtained by the average citizen to reload his own sporting ammunition, Fe—W shot and the special plastic wads, which make it safer to use have not been made available to the public for reloading.

A composite of tungsten powder and a powdered polymer is disclosed in U.S. Pat. No. 4,949,645 to Hayward et al. This shot material is a composite of tungsten powder and a powdered polymer (e.g., nylon, polyethylene, et al). Mixtures of these two constituents are formed into spheres of cured composite, the polymer "glue" being the continuous phase, and the tungsten powder particles, the discontinuous phase. By virtue of its weak polymer-to-metal bonds, the material will reportedly not damage gun barrels. It is this very "weakness", however, which is one of the undesirable features of tungsten-polymer shot. Rigidity and strength are important material properties that affect the ability of shot to (1) penetrate the target effectively, and (2) remain spherical during launch and flight.

Because the elastic moduli of all organic polymers are far lower than those of metals, the subject composite materials are, as expected, less rigid than steel, Fe—W, et al. This results in degraded penetration. Moreover, this shot is also subject to permanent distortion, referred to as "plastic deformation, which results in a loss of sphericity. Any loss of sphericity results in erratic flight paths of shot and, therefore, produces undesirable pattern uniformity.

Another disadvantage of tungsten-polymer shot is one of economics. Because polymers are much lower in density than common metals such as iron, a composite density equivalent to that of lead shot (11.0 g/cm$^3$) can only be attained by using high concentrations (e.g., 95%) of costly tungsten powder.

As in the case of bismuth, tungsten-polymer shot is non-magnetic, making it difficult for law enforcement to distinguish it from illegal lead shot.

Alternative shot materials in this category are disclosed in U.S. Pat. No. 5,279,787 to Oltrogge, U.S. Pat. No. 5,399,187 to Mravic et al, and U.S. Pat. No. 4,784,690 to Mullendore et al. As in the case of Fe—W shot, such processes at most can only be expected to be economically feasible for the larger shot sizes, which have limited usefulness.

Other proposed shot materials include significant concentrations of lead as a specified ingredient. Recent rulings by the U.S. Fish and Wildlife Service have outlawed the use of any shot material containing more than 1.0% lead. This action has eliminated consideration of proposed materials described in a variety of U.S. Patents: U.S. Pat. Nos. 2,995,090 and 3,193,003 to Daubenspeck; U.S. Pat. No. 4,027,594 to Olin; U.S. Pat. No. 4,428,295 to Urs; U.S. Pat. No. 4,881,465 to Hooper; and U.S. Pat. No. 5,088,415 to Huffman et al are examples.

Even materials that are lower in density than steel have been proposed for alternative shot. Examples are zinc (7.14 g/cm$^3$) and tin (7.3 g/cm. 3). Such materials certainly offer no improvement in ballistic properties over those of steel shot.

BRIEF DESCRIPTION OF THE INVENTION

The instant invention over comes these problems. It consists of a shot pellet that, in one embodiment, has an inner core of tungsten carbide that is coated with a layer of bismuth. This coating is molecularly bonded to the tungsten carbide and is not an alloy.

The instant invention addresses the disadvantages of the shot addressed above, while maintaining all advantages. The unique properties of the instant invention allow its density to be tailored. As explained in below, the effective density of the instant invention can be made to be identical to lead for direct replacement in current lead loading formulations. Additionally, the density can be made to be lower than lead for shotguns requiring low barrel pressures, or higher than lead for enhanced energy transfer while maintaining the other advantages of the instant invention.

BRIEF DESCRIPTION OF THE DRAWINGS

FIG. 1 is a table showing a comparison of test-firings using a variety of prior art shot pellets and pellets of the instant invention.

Figure 2:
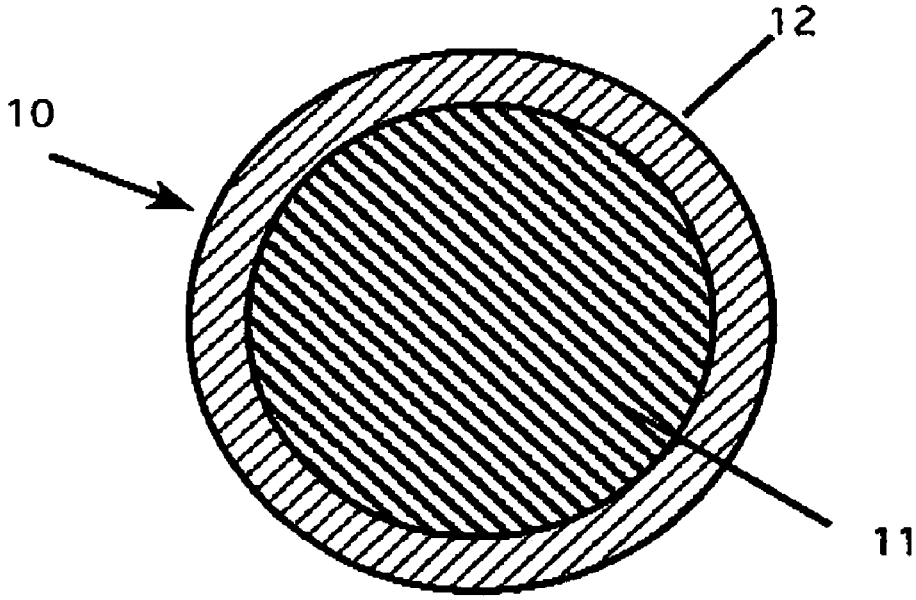
FIG. 2 is a cross-section of a shot pellet according to the instant invention.

An alternative method of manufacture involves the use of a continuous hollow wire of bismuth or, preferably, bismuth-tin. A tungsten core is then inserted into the center of the hollow wire. Preferably, the tungsten core is actually a slurry or tungsten power bound in a digestive wax. This mixture is then inserted into the wire. The result is a wire with a tungsten core and a covering of bismuth or bismuth-tin. This wire is then processed by segmenting it into small sections, which are then cut and punch pressed into individual spheres. This embodiment 10 is shown in FIG. 2. The hollow wire of an outer metal 12 is shown with the inner core 11 in the FIG.

DETAILED DESCRIPTION OF THE INVENTION

The instant invention is a two-part shot that uses an inner core of Tungsten, or Tungsten Carbide, or Tungsten Iron. All of these materials have a density greater than that of lead. All are considered non-toxic by US EPA, and are approved for hunting on federal game lands. The inner core is then encased in an outer core of Bismuth, or Bismuth/Tin alloy.

Both of these materials have a density less than that of lead. Both are considered non-toxic by US EPA and are approved for hunting on federal game lands.

In one embodiment, the invention uses an optional binding layer of Nickel. This material has a density less than that of lead, is considered non-toxic by US EPA, and is approved for hunting on federal game lands.

Additional materials having a density equal to or greater than lead and non-toxic can be used for the inner core. However, tungsten or tungsten carbide are preferred.

Additional materials having a density equal to or less than lead and non-toxic can be used for the outer core.

The weight of a sphere may be expressed in terms of both its density and its diameter. The equation for this calculation is:

$$W=(4/3)*\pi*r^3*d \quad \text{EQ1}$$

where r=Radius of sphere and d=density of material of construction.

The weight of a sphere with an outer annulus of dissimilar material may also be expressed in terms of the density and diameter of both the inner and outer material. The equation for this calculation is:

$$W=(4/3)*\pi*r^3_{inner}*d_{inner}+(4/3)*\pi*r^3_{outer}*d_{outer}-(4/3)*\pi*r^3_{inner}*d_{outer} \quad \text{EQ2}$$

Where $r_{inner}$=radius of inner material and $d_{dinner}$=density of inner material of construction and $r_{outer}$=radius of outer material and $d_{outer}$=density of outer material of construction.

Equation 2 may be simplified to equation 3

$$W=(4/3)*\pi*(r^3_{inner}*d_{inner}+r^3_{outer}*d_{outer}-r^3_{inner}*d_{outer}) \quad \text{EQ3}$$

Where all the terms have been defined above

For the following examples, the following data is used:

| | |
|---|---|
| 11.3 g/cc | Density Lead |
| 8.90 g/cc | Density Nickel |
| 9.79 g/cc | Density Bismuth |
| 9.71 g/cc | Density Bismuth/Tin |
| 19.30 g/cc | Density Tungsten |
| 15.00 g/cc | Density Tungsten Carbide |
| 15.00 g/cc | Density Tungsten Iron Alloy |

Note that the final outer diameter may be varied to produce materials of virtually any diameter. The examples below will use standard shot sizing.

Methods of Manufacture

In the broadest sense, this invention produces a multilayered annular metallic composite where the finished product has an outer surface with the hardness and lubricity properties of lead and an inner core with enhanced density.

The examples below describe preferred embodiments. Additional methods of manufacture similar to these methods, but not described below can be used with equal results.

In this embodiment, three methods of manufacture are disclosed. The first is the use of powder and punch press technology to produce a finished sphere. The second is the use of powder and pre-made core technology to produce a finished sphere. The third is the use of powder and punch press technology to produce a finished sphere of pure Bismuth tin.

The following examples illustrate these methods. Note that the size and densities of shot pellets produced in these examples are not limited. The size of shot shown is merely an example of the process. All sizes of shot can be made using any of these processes, within the limitations of the densities of the material. As discussed above, the densities can be set to be equal that of lead, or to be lighter or heavier, as desired.

EXAMPLE 1

The use of powder and punch press technology to produce a finished sphere equivalent to # 8 shot at the exact equivalent density of lead using a core of tungsten. Note that the equivalent diameter of #8 shot is 2.29 mm. Tungsten powder (−200 mesh) is pressed in a punch press at 25 tons to form an inner core of 1.257 mm. This inner core is then cleaned to remove residual press oils. The resulting inner core is then inserted in a second press. This press uses the inner core and a quantity of bismuth/tin powder (−200 mesh), which is pressed at 23 tons to form a finished sphere of 2.29 mm. By using an inner core of 1.257 mm and a final sphere size of 2.29 mm, the effective density is exactly equivalent to that of lead, and the diameter is precisely that of # 8 shot with an approximate hardness equivalent to that of lead.

EXAMPLE 2

The use of powder and pre-made core technology to produce a finished sphere equivalent to #7.5 shot at the equivalent density of a heavy shot (1.1× density of lead) using a core of tungsten carbide. Note that the equivalent diameter of #7.5 shot is 2.41 mm. A tungsten carbide core of 1.930 mm is selected as the inner core for this example. The core is cleaned and referred to below as the inner core. A punch press uses the inner core and a quantity of bismuth/tin powder (−200 mesh), which is pressed at 23 tons to form a finished sphere of 2.41 mm. By using an inner core of 1.930 mm and a final sphere size of 2.41 mm, the effective density is exactly equivalent to that of 110% of lead, and the diameter is precisely that of # 7.5 shot. The bismuth/tin alloy has an approximate hardness equivalent to that of lead.

EXAMPLE 3

The use of powder and punch press technology to produce a finished sphere equivalent to #4 shot at any density below that of pure Bismuth tin using a core of mixed tungsten/bismuth. Note that the equivalent diameter of #4 shot is 3.30 mm. A blend of tungsten powder (−200 mesh) and 97/3 bismuth/Tin and is pressed in a punch press at 25 tons to form a inner core of 2.167 mm. This inner core is then cleaned to remove residual press oils. The inner core is placed in a punch press with a quantity of bismuth/tin powder (−200 mesh) and pressed at 23 tons to form a finished sphere of 3.30 mm. For the case where the density of the finished shot equals that of bismuth tin (9.71 g/cc, or 86% of lead), the inner core is comprised of 100% bismuth tin. For the case where the density of the finished shot equals that of a heavy shot (12.43 g/cc, or 110% of lead), the inner core is comprised entirely of tungsten, with an outer annulus of bismuth/tin. By using an inner core of 2.167 mm and a final sphere size of 3.30 mm, the effective density can be tailored by a simple stochiometric ratio of inner material with the diameter precisely that of # 4 shot. The bismuth/tin alloy has an approximate hardness equivalent to that of lead.

An alternative method of manufacture involves the use of a continuous hollow wire of bismuth or, preferably, bismuth-tin. A tungsten core is then inserted into the center of the hollow wire. Preferably, the tungsten core is actually a slurry or tungsten power bound in a digestive wax. This mixture is then inserted into the wire. The result is a wire with a tungsten core and a covering of bismuth or bismuth-tin. This wire is then processed by segmenting it into small sections, which are then cut and punch pressed into individual spheres.

FIG. 1 is a table showing a comparison of various forms of prior art shot and the shot made with the process discussed herein. The table shows the type of shot used and the loading specifications and the ballistic characteristics for each type of shot. The purpose of this table is to show the comparison of the lead shot alternatives to actual lead shot. As shown in the figure a sample of the shot was made that compares directly to a number 7.5 lead shot. As expected, the difference between the lead shot and the shot of the instant invention was negligible. Thus, pellet for pellet, the characteristics of the shot of the instant invention are equal that of lead. Using the shot of the instant invention allows loading of shells using the same tables, charts, tools and equipment for loading lead shells.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

What is claimed is:

1. A method of forming a shot pellet comprising the steps of a) providing a hollow wire of an outer metal;

b) inserting an inner core of a second metal into said hollow wire, forming a filled wire;

c) segmenting said filled wire into discrete units;

d) placing each of said discrete segments into a punch press; and e) pressing each of said discrete units into a sphere.

2. The method of claim 1 wherein the outer metal is selected from the group of Bismuth and Bismuth-tin.

3. The method of claim 1 wherein the inner metal is selected from the group of tungsten, or tungsten carbide.

4. The method of claim 1 wherein the inner metal is a slurry containing a tungsten power and a digestible wax binder.

* * * * *